United States Patent [19]

Marquardt

[11] Patent Number: 5,050,775

[45] Date of Patent: Sep. 24, 1991

[54] BEVERAGE DISPENSER AND CUP HOLDER

[75] Inventor: John R. Marquardt, Fond Du Lac, Wis.

[73] Assignee: International Paper Company, Purchase, N.Y.

[21] Appl. No.: 430,661

[22] Filed: Oct. 31, 1989

[51] Int. Cl.[5] ..... B65D 35/24

[52] U.S. Cl. ..... 222/93; 222/105; 222/386; 248/311.2; 248/152; 220/462; 220/403; 229/110

[58] Field of Search ..... 222/92, 95, 105, 183, 222/185, 386, 386.5, 481, 93, 466; 248/311.2, 152, 174; 220/93, 403, 462; 229/110

[56] References Cited

U.S. PATENT DOCUMENTS

| | | | |
|---|---|---|---|
| 2,570,283 | 10/1951 | Stevens | 222/481 |
| 2,716,508 | 8/1955 | Booth | 222/131 |
| 2,751,138 | 6/1956 | Laver | 229/110 |
| 3,123,254 | 3/1964 | Rabby et al. | 222/105 |
| 3,349,987 | 10/1967 | Chapman et al. | 220/403 |
| 3,817,444 | 6/1974 | Yoch | 220/403 |
| 4,205,775 | 6/1980 | Swan | 229/110 |
| 4,208,954 | 6/1980 | Chase | 229/110 |
| 4,623,075 | 11/1986 | Riley | 222/95 |
| 4,666,059 | 5/1987 | Nordstrom | 222/105 |
| 4,850,506 | 7/1989 | Heaps, Jr. et al. | 222/105 |

*Primary Examiner*—Michael S. Huppert
*Assistant Examiner*—Kenneth Bomberg
*Attorney, Agent, or Firm*—Walt Thomas Zielinski

[57] ABSTRACT

This relates to a beverage dispenser and more particularly to a disposable carton in which a bag containing a selected beverage may be mounted to facilitate the dispensing of the beverage. The carton is of a four piece construction including a tubular multi-sided carton body, a base on which the beverage bag is supported, a support slidably mounted in the carton body for supporting the filler of the beverage bag, and a cap. All necessary components of the carton automatically lock together when folded and no adhesives are required. There is also a cup holder which may be selectively mounted on the carton or which may be supported independently of the beverage dispenser adjacent the beverage dispenser.

14 Claims, 8 Drawing Sheets

FIG. 8
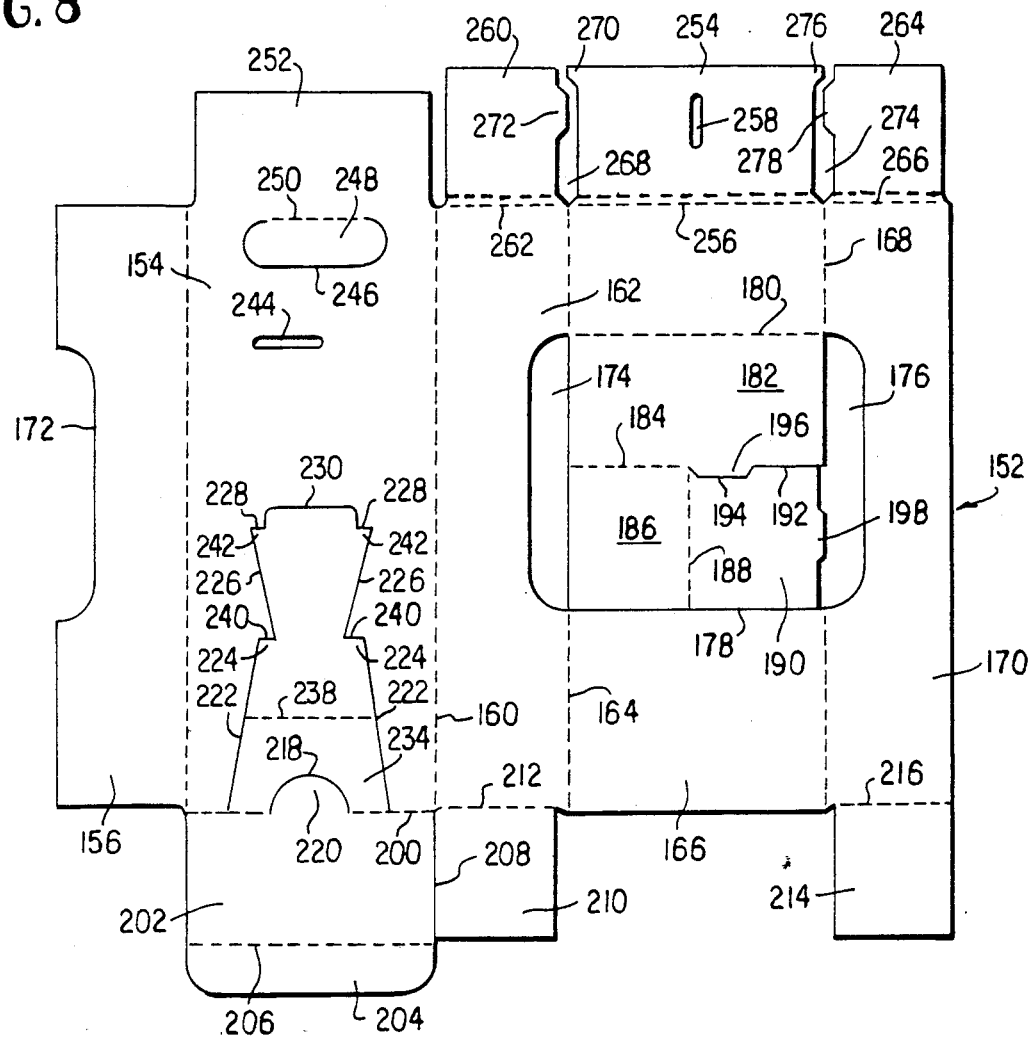
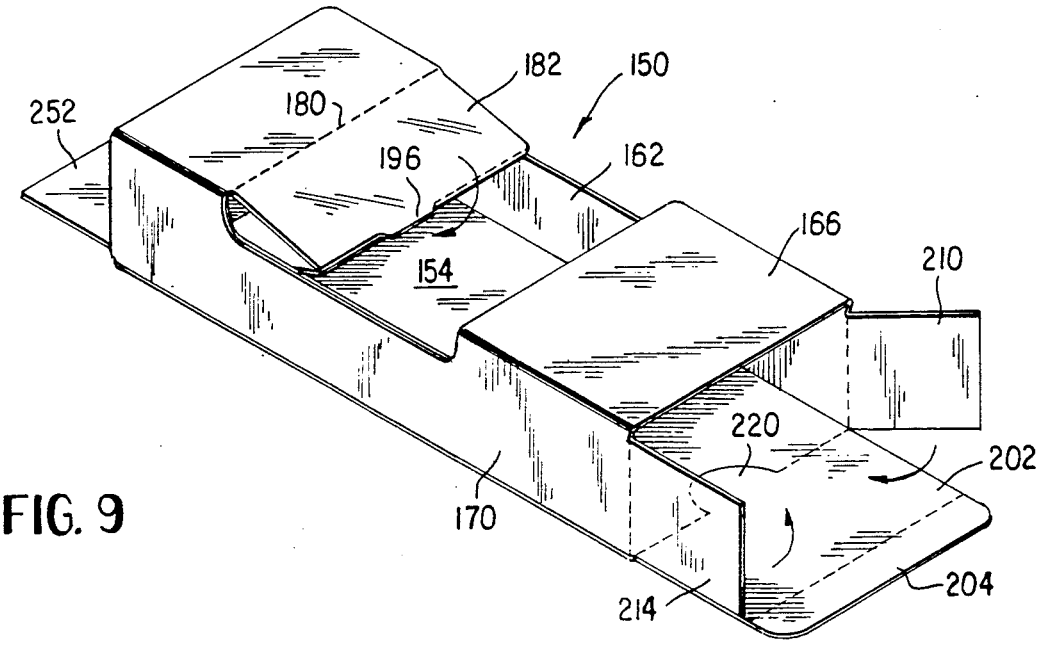
FIG. 9

BEVERAGE DISPENSER AND CUP HOLDER

This invention relates in general to new and useful improvements in cartons, and more particularly to a carton for receiving a collapsible bag in the formation of a beverage dispenser.

This invention, in particular, relates to a beverage dispenser of the type specifically disclosed in U.S. Pat. No. 4,771,917 granted to Harry B. Heaps, Jr. et al on Sept. 20, 1988. The carton in accordance with this disclosure is much simpler than that of the Heaps, Jr. patent and may be more economically formed.

In accordance with this invention, there is provided a four piece carton which includes a multi-sided body, a base on which a bag containing a liquid, such as a beverage, is supported, a support for the bag filler which is telescoped within the body for vertical movement, and a cap.

The base has a top wall on which the bag may seat while the bag is locked to the body by way of its outlet. The base is provided with dependent flaps which engage the sides of the carton and each side of the carton is provided with a reversely foldable flap for locking within the base flaps.

The cap is specifically constructed for use in conjunction with an even number multi-sided carton includes a top panel of a multi-sided configuration. Every other side of the top panel is provided with a single thickness depending flap. Each depending flap is provided with laterally extending tabs. The other sides of the cap top wall have hingedly connected thereto outer flaps which lie outwardly of the projecting tabs and each outer flap is provided with an inner flap which is reversely folded inside of the respective pair of tabs and locked against the underside of the end wall. This provides for a rigid wall configuration without the use of fasteners.

There is also provided a cup holder. The cup holder is constructed so that it may be attached to one side of the carton or may be separate from the carton and be provided with its own brace to mount it in a vertical position on a support. The cup holder is formed from a separate blank and is generally in the form of a hollow tube having a lower portion in the form of a cup compartment and having a portion of a front wall of the tube cut out and folded upwardly to form at least a bottom wall of an upper open compartment.

The cap may advantageously be formed of a generally triangular blank when the carton is of a six sided configuration.

With the above and other objects in view that will hereinafter appear, the nature of the invention will be more clearly understood by reference to the following detailed description, the appended claims, and the several views illustrated in the accompanying drawings.

FIG. 8 is a plan view of a blank for a cup holder.

FIG. 9 is a perspective view showing the partially folded cup holder.

Figure 1:
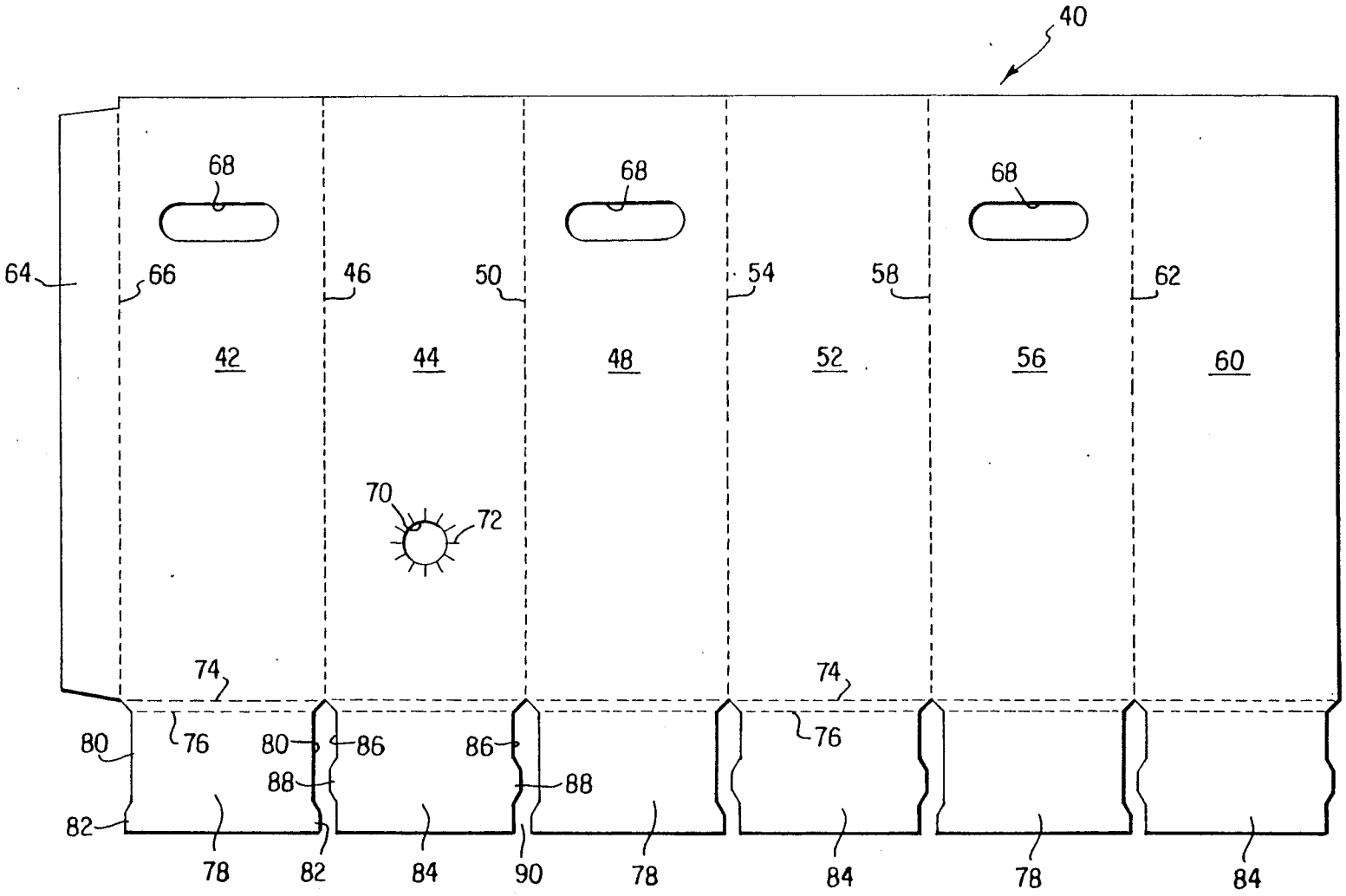
FIG. 1 is a plan view of a blank for forming the carton body.
Figure 2:
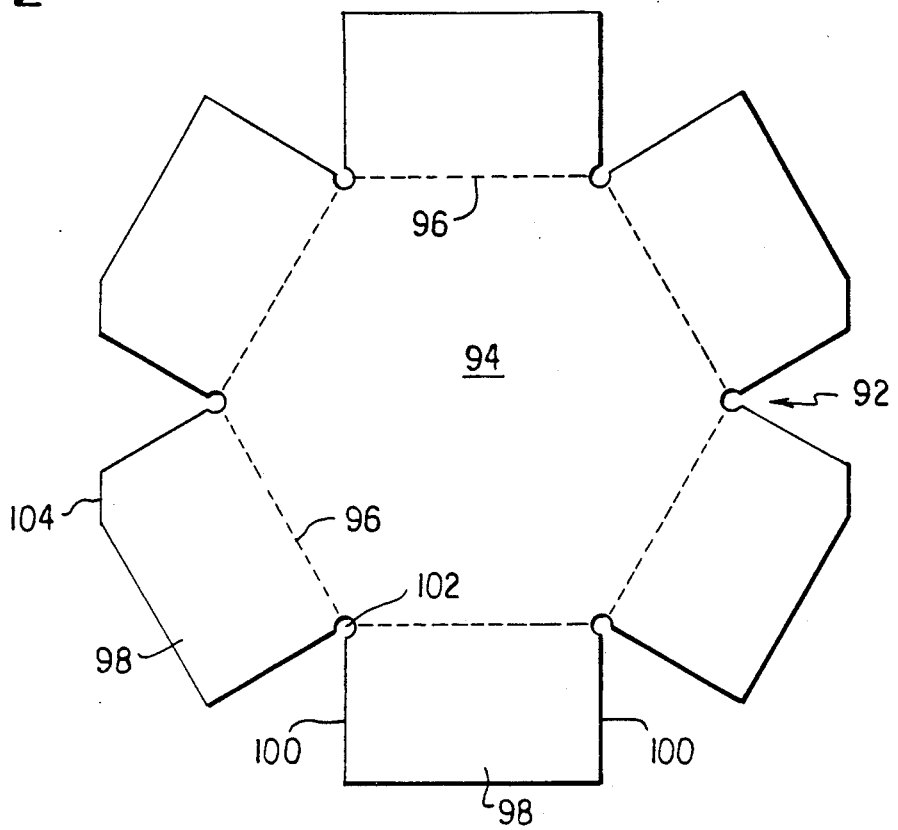
FIG. 2 is a plan view of a blank for forming the carton base.

Referring now to the drawings in detail, the specifics of the beverage dispenser will be first described. The overall details of the beverage dispenser, which is generally identified by the numeral 20, are best illustrated in the vertical sectional view of FIG. 7. It will be seen that the beverage dispenser includes a carton 22 which has mounted therein a collapsible bag 24 which is intended to contain a beverage such as coffee, hot or cold tea, lemonade and the like. The bag 24 is provided with an upper filler 26 which is normally closed by means of a cap 28. The bag 24 is also provided with an outlet 30 to which there may be attached a suitable spigot (not shown).

It will be seen that the carton 22 includes a multi-sided, preferably six, tubular carton body 32 which is provided with a base, generally identified by the numeral 34. The base 34 is constructed to form a seat for the bag 24.

Telescoped within the body 32 above the bag 24 and forming a support for the bag filler 26 is a support generally identified by the numeral 36. The support 36 is mounted within the carton body 32 for vertical sliding movement as the bag 24 collapses due to the liquid therein being dispensed.

Finally, the carton 22 includes a cap, generally identified by the numeral 38 which is telescoped over and closes the carton body 32.

Referring now to FIG. 1, it will be seen that there is illustrated the details of a blank, generally identified by the numeral 40, for forming the carton body 32. The blank 40 is preferably formed of corrugated board although the invention is not so limited. The blank 40 is for a six sided carton body with six being the preferred number of sides for the carton body although the invention is not so limited. The six sides form a major portion of the blank 40 and includes adjacent sides 42, 44 separated by a fold line 46. The next adjacent side 48 is separated from the side 44 by a fold line 50. In a like manner, the next adjacent side 52 is separated from the side 48 by a fold line 54. The side 56 is separated from the side 52 by a fold line 58 and, finally, a terminal side 60 is separated from the side 56 by a fold line 62.

The carton blank 40 also includes a glue flap 64 at the opposite end of the blank 40 from the side 60. The glue flap is separated from the side 42 by a fold line 66.

In the illustrated form of the carton blank 40, the sides 42, 48 and 56 have formed in upper portions thereof transversely elongated openings 68 in the form of hand holes for facilitating the carrying of the dispenser 20.

Also, a lower portion of the side panel 44 is provided with a circular opening 70 outlined by a plurality of radiating cuts 72 for receiving the outlet 30 in a manner to be described in more detail hereinafter.

At the bottom of each of the side panels 42, 44, 48, 52, 56 and 60 there is a pair of transverse, parallel fold lines 74, 76. The fold lines 76 of the side panels 42, 48 and 56 form a latching means for first locking flaps 78 which are arranged in depending relation. The first locking flaps 78 are generally rectangular in outline and have opposite sides 80. At the bottom of each of the first locking flaps 78, remote from the fold line 76, there is projecting from each of the sides 80 a locking tab 82.

The fold lines 76 of the side panels 44, 52 and 60 have depending therefrom second locking flaps 84. The second locking flaps 84 are also generally rectangular in outline and include remote sides 86. Each of the sides 86 has projecting therefrom in spaced relation from a remote edge of the second locking flap 84 a locking tab 88. It is to be noted that the locking tabs 88 are spaced above the locking tabs 82.

It is to be particularly noted that between each pair of locking flaps 78, 84 there is a cutout of a width greater than the width of the projections 82, 86.

Figure 6:
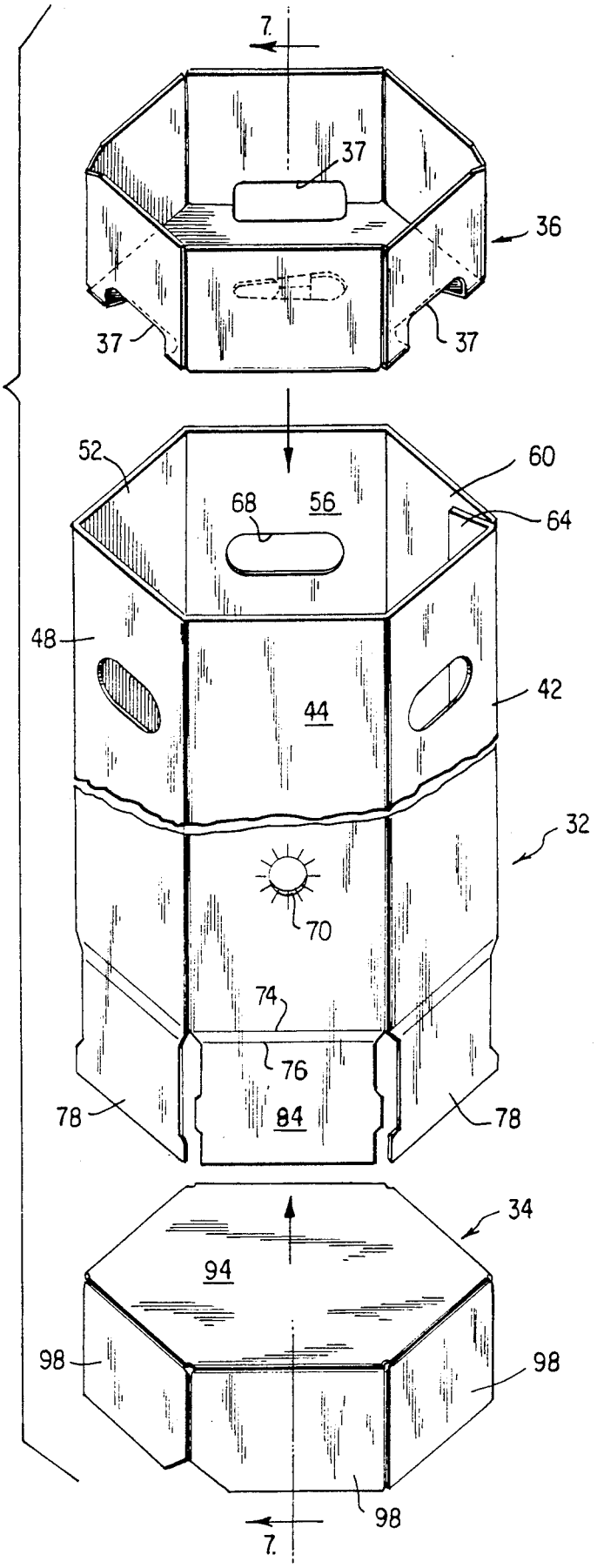
FIG. 6 is an exploded perspective view of the components of the carton exclusive of the cap.

As is best shown in FIG. 6, the carton body 32 is first formed by folding of the blank 40 along each of the vertical fold lines and thereafter gluing the glue flap 64 to the inner surface of the side panel 60.

The base 34 is formed from a blank 92 which is also preferably formed of corrugated board. The blank 92 includes, in the case of a six sided carton body 32, an octagonal central panel 94 having six sides each defined by a fold line 96. A side panel 98 extends from the panel 94 along the respective fold line 96.

Each side panel 98 is rectangular in outline and includes remote edges 100. Adjacent side panels 98 have their edges 100 arranged in generally intersecting relation, but are separated by a generally circular cut 102 disposed generally at each end of an adjacent pair of fold lines 96 and centered relative to the would be intersecting fold lines 96.

It is to be noted that two pairs of oppositely directed side panels 98 have adjacent corners cut away as at 104.

In order to form the base 34, the side panels 98 are merely folded down as shown in FIG. 6.

Figure 7:
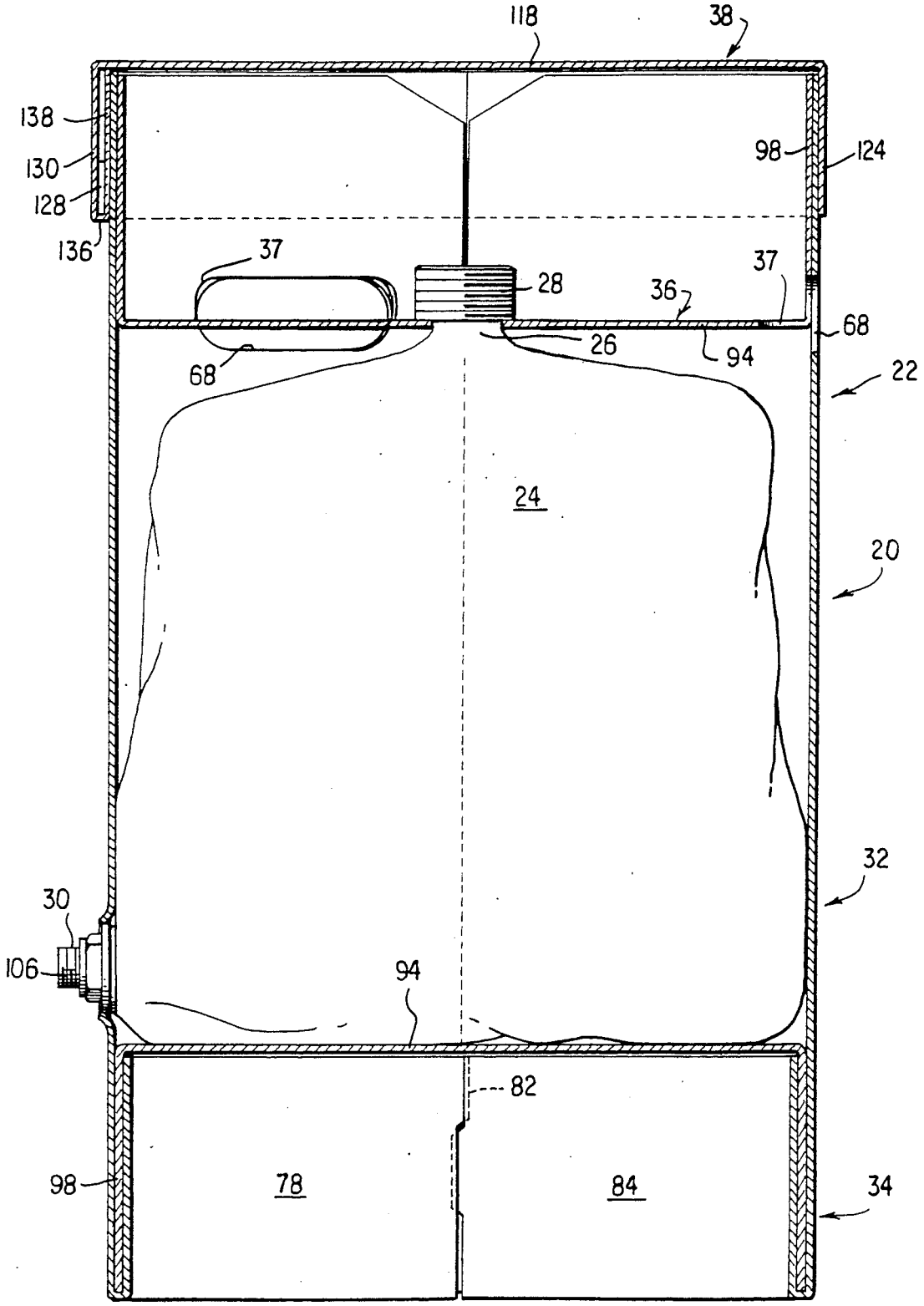
FIG. 7 is a vertical sectional view taken generally along the line 7—7 of FIG. 6 through the completed carton including the beverage containing bag.
Figure 10:
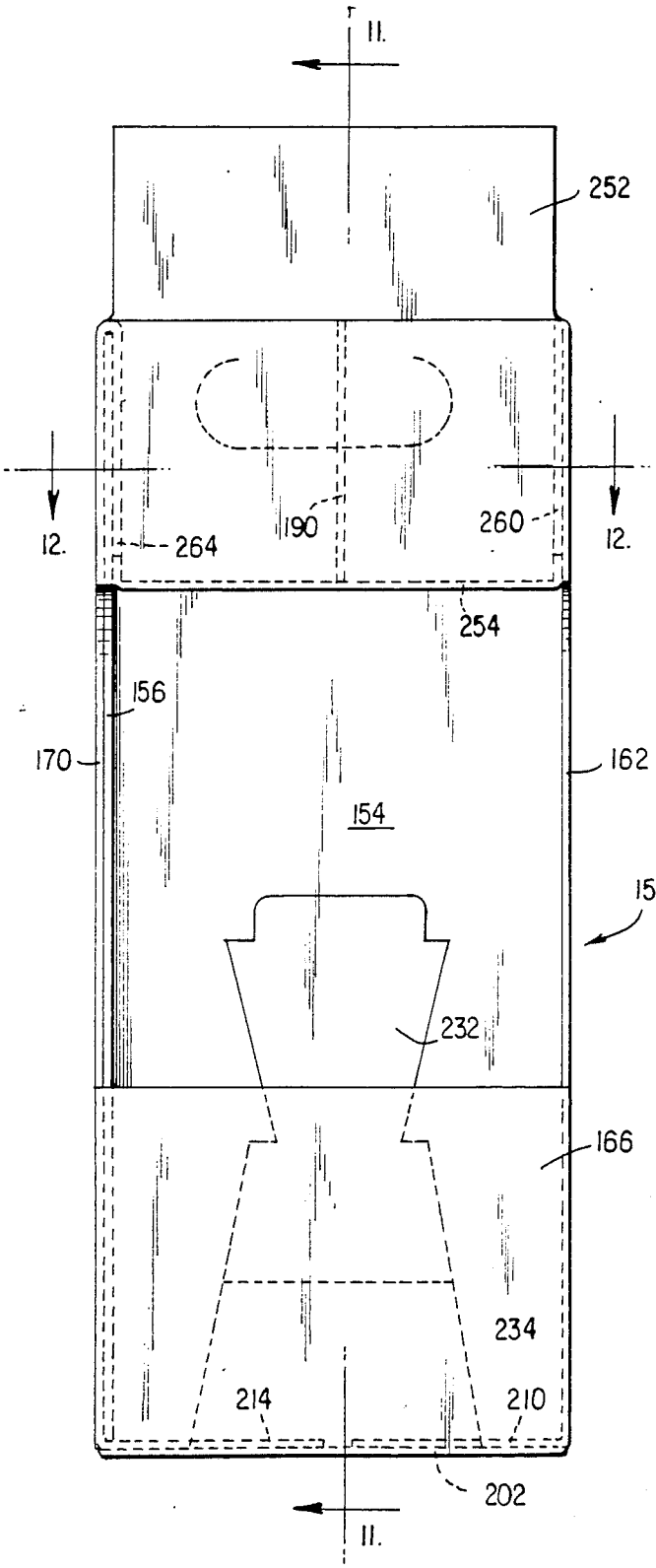
FIG. 10 is a front elevational view of the cup holder.

The base 34 is telescoped within the lower portion of the carton body 32 so that the lower edges of the side panels or flaps 98 are above the fold lines 74. With the base 34 being so positioned, the locking flaps 78, 84 are reversely folded relative to the side panels into the interior of the carton body 32 to the position shown in FIG. 7. When the side panels or flaps 78, 84 are fully folded, the projecting tabs 82 are locked behind the adjacent flaps 84 while the projecting tabs 88 of the flaps 84 are locked behind the adjacent flaps 78. This is best shown in FIG. 7. The base 34 is now fixed in position relative to the carton body 32 and ready to receive the bag 24. The bag 24 is preferably empty and already assembled with the support 36 as will be described hereinafter. The outlet 30, which has a smaller diameter projecting spigot receiving portion 106 is first aligned with the hole 70 and then pulled through the hole so that the carton body 32 is expanded by the opening of the slits or cuts 72 as is shown in FIG. 7.

Figure 3:
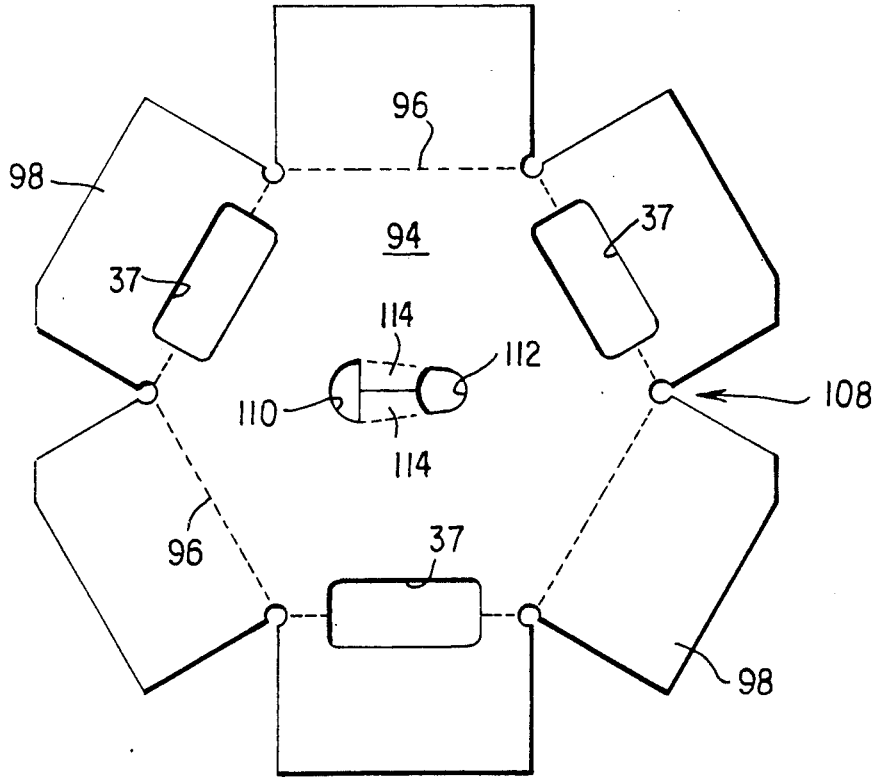
FIG. 3 is a plan view of a blank for forming the filler support.

The support 36 is formed from another blank 108 which is also preferably formed of corrugated board. The blank 108 has the same outline and overall configuration as the blank 92. However, the center panel 94 thereof is provided at the center thereof with a pair of cutouts 110, 112 which are separated by a pair of hinged flaps 114. When the bag filler 26 is to be attached to the support 36, the flaps 114 are moved apart, the filler 26 is moved into the open space joining the two cutouts 110, 112 and then the filler 26 is moved into the cutout 112, after which the flaps 114 are folded back to their original positions to lock the filler to the panel 94. Three generally rectangular openings 37 are provided in blank 108, with each opening straddling alternate fold lines 96. Openings 37 are angularly spaced about 120 degrees apart and are aligned with openings 68 of carton 22 in at least one position of support 36 relative to supporting based 34 as may be seen at FIG. 7. Also as seen at FIG. 7, side panels 98 of blank 108 (also see FIG. 3) are upstanding in the completed carton.

As is clearly shown in FIGS. 6 and 7, the support 36 is freely slidable within the carton body 32 and may move up or down depending on whether the bag 24 is being filled or the product therein is being dispensed. The partially formed dispenser 20 is now ready to receive the cap 38.

Figure 4:
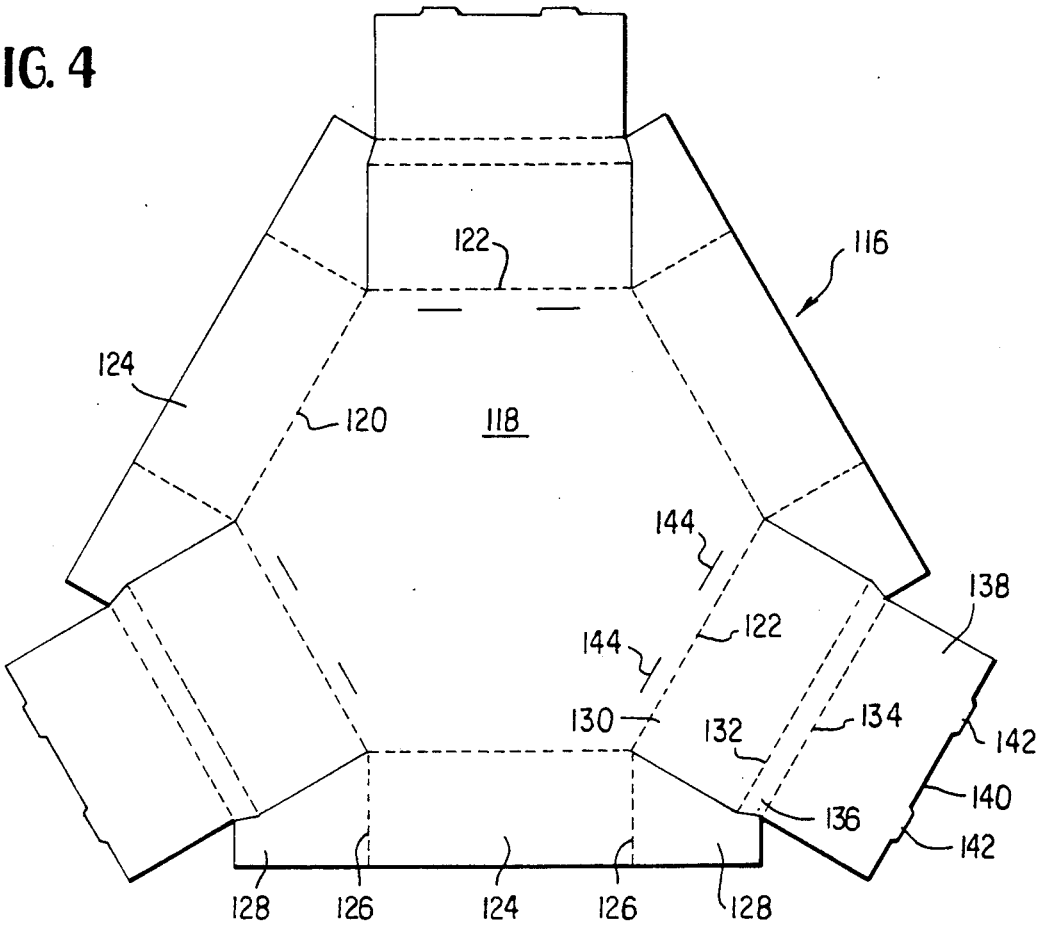
FIG. 4 is a plan view of a blank for forming the cap.

Referring now to FIG. 4, it will be seen that when the carton body 32 is of a six sided configuration, the blank 116 from which the cap 38 is formed is generally triangular in outline. The blank 116 is also preferably formed of corrugated board like the other blanks.

The blank 116 includes a central portion in the form of an end panel 118 which is hexagonal in outline and defined by alternating first fold lines 120 and second fold lines 122. The first fold lines 120 have hingedly connected thereto side panels or flaps 124. Each side panel or flap 124 has side edges thereof defined by fold lines 126 along which laterally projecting tabs 128 are connected to each flap 124. Second side panels or flaps 130 are hingedly connected to the end panel 118 along the second fold lines 122. Each side panel 130 terminates remote from its fold line 122 in a fold line 132. Between each fold line 132 and the next outer parallel fold line 134 is a fold strip 136 which decreased in width outwardly as clearly shown in FIG. 4.

A locking flap 138 is carried by each panel 130 along the fold lines 132, 134. Each locking flap 138 has a free edge 140 from which a pair of spaced locking tabs 142 project.

Particularly when the blank 116 is formed of corrugated board, that layer of the corrugated board which forms the underside of the end panel 118 is provided with a pair of aligned, spaced cut lines or slits 144 in positions to receive the locking tabs 142 of the associated locking panel 138.

Figure 5:
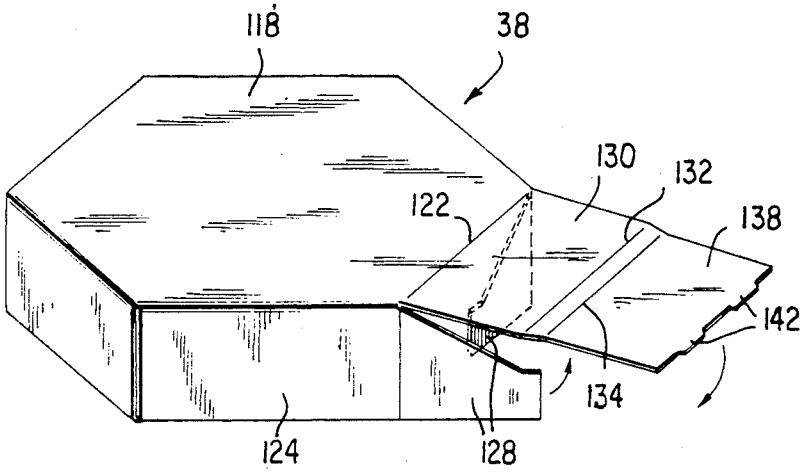
FIG. 5 is a top perspective view of the cap prior to a final folding action and shows the details of the cap.

The cap 38 is formed by first folding down the first side panels 124 and then folding the projecting tabs 128 towards each other. This is clearly shown in FIG. 5. Then, an associated second side panel 130 is folded down along its associated hinge line 122 outwardly of the projecting tabs 128. Thereafter, the locking tab carried by the respective side panel 130 is folded inwardly and then up along the fold lines 132, 134 to a position inside of the tabs 128. The projecting tabs 142 are then engaged in the cut lines or slits so as to lock the locking tabs 138 in position.

The cap 38 is now complete and may be telescoped over the upper part of the carton body 32, as is shown in FIG. 7. This, in turn, completes the beverage dispenser 22, assuming that the bag 24 has been previously filled through the filler 26.

The beverage dispenser 20 may have associated therewith a cup holder which is generally identified by the numeral 150 and which is best shown in FIGS. 8 through 14.

The cup holder 150 is formed from a generally rectangular blank 152 which is also preferably formed of corrugated board. The blank 152 is provided with a plurality of longitudinal fold lines which define in sequence a rear panel 154 which is separated from a side panel 156 by a fold line 158. A fold line 160 separates the rear panel 154 from a side panel 162. An interrupted fold line 164 separates the second side panel 162 from a front panel 166. Finally, an interrupted fold line 168 separates a third side panel 170 from the front panel 166.

It is to be noted that the side panel 156 has remote from the fold line 158 a cutout 172. Like cutouts 174 and 176 are formed in the side panels 162, 170. A transverse cut line 178 connects together the bottoms of the cutouts 174, 176 while a transverse fold line 180 connects together the tops of the cutouts 174, 176. The material of the front panel 166 between the cut line 178 and the fold line 180 includes a transverse panel 182 carried by the front panel 166 along the fold line 180. Next, a short fold line 184 connects to the panel 182 a smaller panel 186. The panel 186 has connected thereto along a longitudinal fold line 188 another small panel 190. The panel 190 is separated from the panel 182 by a cut line 192 which has an offset portion 194 defining a projecting locking tab 196 on the panel 182.

Finally, the configuration of the cutout 176 is such so as to provide a central projecting tab 198 on the side of the panel 190 remote from the fold line 188.

At the bottom of the rear panel 154 there is an interrupted fold line 200 which defines a bottom panel 202. The bottom panel 202 carries a locking flange 204 separated therefrom along a transverse fold line 206.

Next to the bottom panel 202 and separated therefrom by a longitudinal cut line 208, which is an extension of the fold line 160, is a bottom flap 210. The bottom flap 210 is connected to the second side panel 162 along a transverse fold line 212 which is slightly offset from the interrupted fold line 200.

A second bottom flap 214 is connected to the side panel 170 along a transverse fold line 216.

The interrupted fold line 200 is interrupted by a generally semi-circular cut line 218 which in certain circumstances will define a mounting flap 220 as will be described in detail hereinafter.

Extending upwardly from the interrupted cut line 200 in spaced relation to the flap 220 are a pair of converging cut lines 222 which terminate in short opposed transverse cut lines 224. Extending upwardly in diverging relation from the cut lines 224 are further cut lines 226 which generally form extensions of the cut lines 222.

The cut lines 226 terminate in opposed short transverse cut lines 228 which, in turn, are joined by an inverted generally U-shaped cut line 230.

All of the above identified cut lines beginning with the cut lines 222 define a stepped panel 232 which includes a lower portion 234 separated from an upper portion 236 by a transverse fold line 238.

The cut lines 224 form on the rear panel 154 a pair of shoulders 240 which face the interrupted fold line 200. In a like manner, the short cut lines 228 form on the upper part of the panel 224 a pair of shoulders 242 which face the interrupted cut line 200.

Above the panel 234, the rear panel 154 is provided with a transverse slot or cutout 244 which is offset to one side of the center of the rear panel 154 for receiving the projecting tab 194.

Near the top of the rear panel 154 there is an upwardly opening C-shaped cutout 246 which defines a flap 248 which is hingedly connected to the rear panel 156 along an upper transverse hinge line 250. When the flap 248 is struck out of the rear panel 154, it defines a hand hole for facilitating the carrying of the cup holder 152.

Finally, the rear panel 154 is provided with a rectangular upper extension 252. The extension 252 is slightly narrower than the rear panel 154. Further, the rear panel 154 is preferably of substantially the same width as one of the side panels of the carton body 32.

At the top of the front panel 166 there is a flap 254 which is connected to the top panel 166 along a transverse double fold line 256. The flap 254 is provided with a centrally located longitudinal slit or slot 258 for receiving the projecting tab 198.

The upper end of the front panel 162 carries a flap 260 along a transverse double fold line 262. A similar flap 264 is carried at the upper end of the side panel 170 along a transverse double fold line 266.

Between the flaps 254 and 260 there is a cutout 268 which narrows both flaps and forms on an upper part of a side of the flap 254 a projecting locking tab 270. Another projecting locking tab 272 is formed on the flap 260 facing towards the flap 254 and below the tab 270.

Another cutout 274, which is a mirror image of the cutout 268, is formed between the flaps 254, 264. The cutout 274 forms on the upper part of the other side of the flap 254 another locking tab 276 and on the flap 264 a projecting locking tab 278 which projects towards the flap 254.

Figure 11:
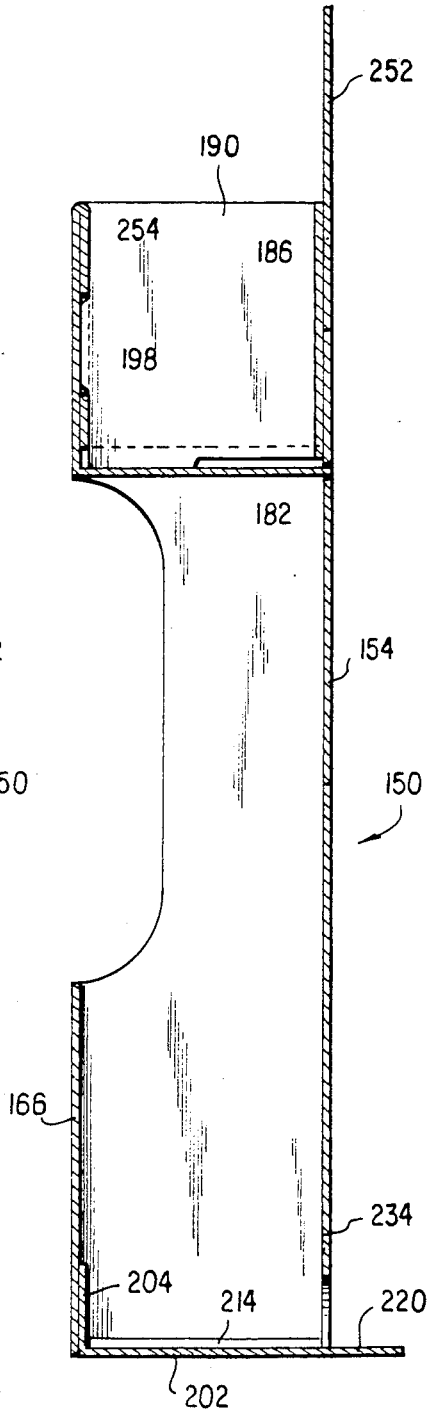
FIG. 11 is a vertical sectional view taken through the cup holder of FIG. 10 generally along the line 11—11 and shows more specifically the details of the cup holder.
Figure 12:
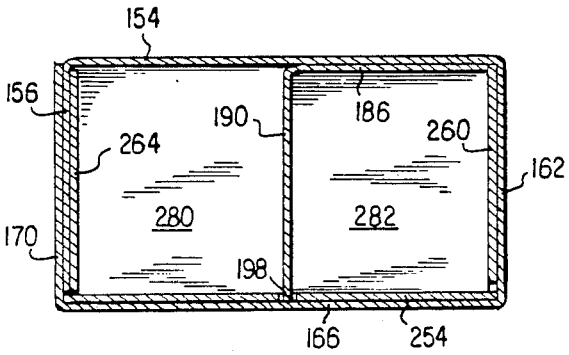
FIG. 12 is a transverse horizontal sectional view taken generally along the line 12—12 of FIG. 10 and shows further the constructional details of the cup holder.

Referring now to FIG. 9, it will be seen that formation of the cup holder 150 is initiated by folding the blank 152 on the fold lines 158, 160, 164 and 168 to form a tube and securing the side panel 156 to the inner surface of the side panel 170. At the top of the cup holder 150, the flaps 254, 260 and 264 are folded inwardly and locked together as is generally shown in FIGS. 11 and 12 by the inter engagement of the tabs 270, 272, 276 and 278 behind the respective adjacent flaps.

The panel 182 is folded about the hinge line 180 up into the top portion of the cup holder 150 and the tab 196 is engaged in the slot 244 to lock the panel 182 in place.

The panels 186 and 190 are folded to upright positions with the panel 186 being adjacent the rear panel 154 and the panel 190 extending normal to the panels 154 and 254. The projecting tab 198 is locked in the slot 258 of the tab 254 so as to divide the newly formed upper compartment into two separate compartments 280, 282 as shown in FIG. 12.

At the bottom of the cup holder 150, the flaps 210, 214 are folded inwardly as shown in FIG. 9, after which the bottom panel 202 is folded upwardly followed by the folding of the locking flange 204 at right angles to the panel 202 and behind the front panel 166. The cup holder 150 is now completed.

Figure 14:
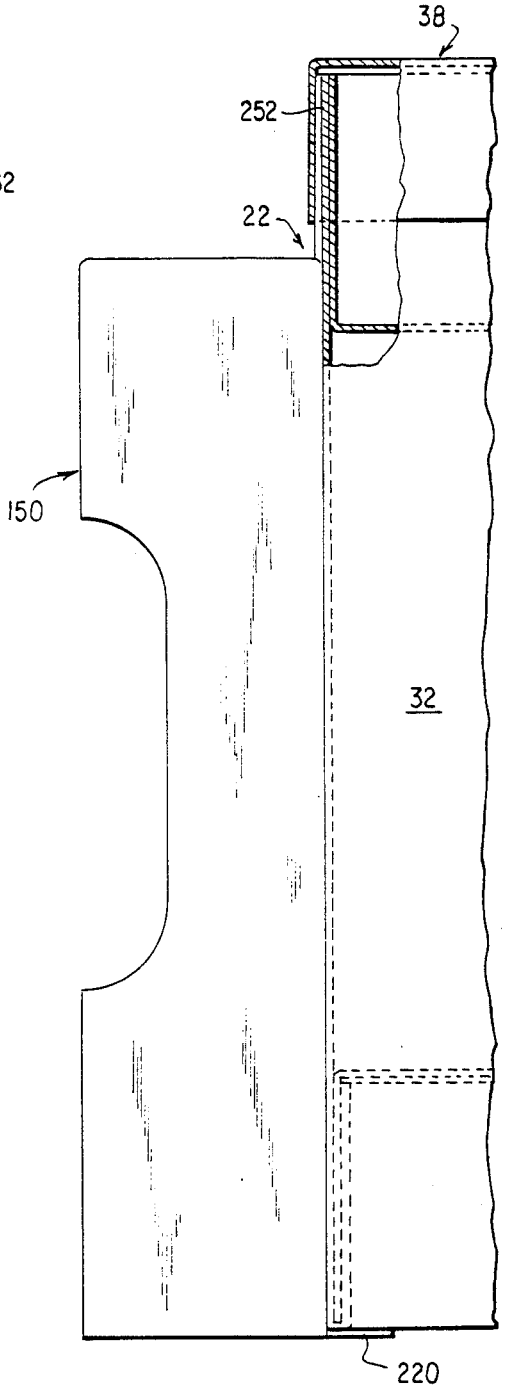
FIG. 14 is an elevational view with parts broken away and shown in section showing the manner in which the cup holder may be mounted on one side of the beverage dispenser.

The cup holder 150 may be utilized in two different manners. In the preferred embodiment of the invention, as shown in FIGS. 11 and 14, the tab 220 is struck out of the panel 234 so as to be coextensive with the bottom panel 202. The cup holder 150 is then placed against one of the panels of the carton body 32, preferably the panel 42 or the panel 48 in a position adjacent the bag outlet 30 with the cap 38 removed. The flap 220 underlies the carton while the flap 252 is disposed in face-to-face relation with an upper part of the selected side panel. The cap 38 is then replaced and the cup holder 150 is now fixed relative to the carton 32. If it is deemed necessary, the tab 220 may be secured to the carton body 32 by way of tape or the like.

Figure 13:
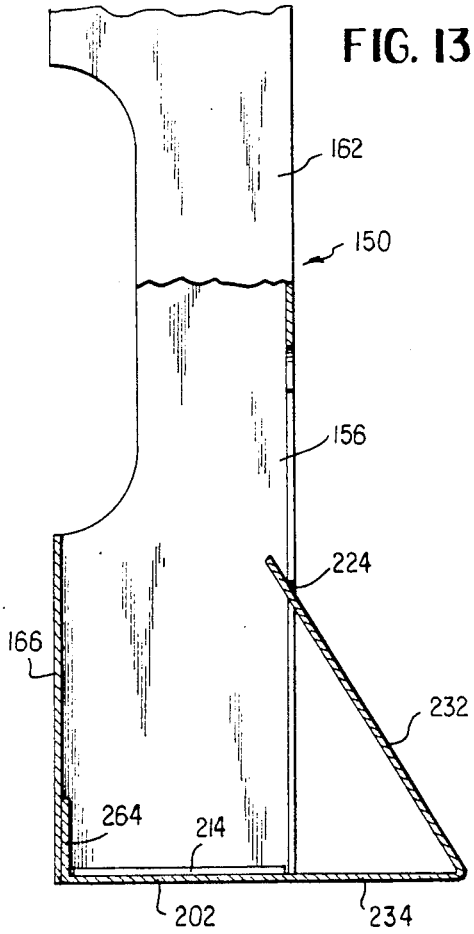
FIG. 13 is a fragmentary elevational view with parts shown in section showing how a struck-out portion of a rear panel of the cup holder may be utilized as a brace when mounting the cup holder independently of the carton.

On the other hand, if the cup holder 150 is to be free standing independently of the beverage dispenser 20, the panels 232, 234 may be struck from the rear panel 154 and folded to the position shown in FIG. 13 where the panel 234 is horizontal and the panel 232 slopes upwardly and rearwardly. At this time the shoulders 242 engage the shoulders 224 to lock the panels 232, 234 in place.

Although only a preferred embodiment of the beverage dispenser and the cup holder have been specifically illustrated and described herein, it is to be understood that minor variations may be made therein without departing from the spirit and scope of the invention as defined by the appended claims.

I claim:

1. In a beverage dispenser, a carton for supporting a collapsible bag, said carton comprising a tubular body, a bag supporting base telescoped within and locked relative to said body, a bag outlet opening in said body above said base, a bag filler support slidably mounted in said body above said base, and a cap telescoped over a top portion of said body, whereby the bag filler support is freely slidable within the carton body and may move up or down depending on whether the bag is being filled with a liquid or a liquid therein is being dispensed.

2. In a beverage dispenser according to claim 1 wherein said body is multi-sided, said base including a top wall and depending flaps, and said body having lower reversely folded flaps telescoped within said base flaps and limiting downward movement of said base in said body.

3. In a beverage dispenser according to claim 2, said body flaps having side edges interlocking with side edges of adjacent ones of said body flaps.

4. In a beverage dispenser according to claim 2, said body flaps having side edges interlocking with side edges of adjacent ones of said body flaps by way of projecting axially spaced tabs.

5. In a beverage dispenser according to claim 1 wherein said body is multi-sided, said bag filler support having upstanding flaps slideably engaging said body sides.

6. In a beverage dispenser according to claim 1 wherein said body is multi-sided, said cap including an end and a plurality of depending side panels in accordance with the number of sides of said body.

7. In a beverage dispenser according to claim 6 wherein the number of said sides is an even number, every other one of said side panels being complete first side panels and of a single thickness, and each of the other side panels being second side panels defined by lateral tabs projecting from said first side panels, a panel forming flap disposed outwardly of said lateral tabs, and a locking flap carried by said panel forming flap disposed inwardly of said lateral tabs.

8. In a beverage dispenser according to claim 7, each of said locking flaps being lockingly engaged with an underside of said end panel.

9. In a beverage dispenser according to claim 1 wherein said body is multi-sided, and a cup holder attached to said body along one of said body sides

10. In a beverage dispenser according to claim 1 wherein said body is multi-sided, and a cup holder attached to said body along one of said body sides by an upstanding flap engaged between said body and said cap and a lower laterally projecting tab underlying lower end of said base.

11. In a beverage dispenser according to claim 9 wherein said cup holder includes a lower open front compartment for cups and an upper open top compartment in part formed by a portion of a front panel of said cup holder.

12. In a beverage dispenser according to claim 11 wherein said portion of a front panel defines a bottom wall of said open top compartment, and said bottom wall carries another portion of said front panel which forms a partition in said top compartment which divides said top compartment.

13. In a beverage dispenser according to claim 1 together with a bag having a top filler and a lower side outlet, said bag being seated on said base with said outlet extending through and fixed relative to said body by said outlet being fixed in said outlet opening, and said bag filler support being seated on said bag and fixedly secured to said bag filler.

14. The beverage dispenser of claim 1 wherein the bag filler support has a support of upstanding side panels, some of said side panels including angularly disposed openings therein, and wherein said carton has a plurality of angularly disposed hand engaging openings located below said cap, said carton hand engaging openings being in registry, in at least one position of the bag filler support relative to said bag supporting base, with said openings in said upstanding side panels of the bag filler support.

* * * * *